United States Patent [19]

Tanaka et al.

[11] 3,935,035

[45] Jan. 27, 1976

[54] AQUEOUS SOLUTION AND METHOD FOR SURFACE TREATMENT OF METALS

[75] Inventors: Tadashi Tanaka, Yokohama; Joji Oka, Tokyo; Katushi Saito, Yokohama, all of Japan

[73] Assignee: Nippon Steel Corporation, Japan

[22] Filed: May 31, 1974

[21] Appl. No.: 475,302

[30] Foreign Application Priority Data

June 5, 1973 Japan ..... 48-63228
Jan. 22, 1974 Japan ..... 49-9630

[52] U.S. Cl. ..... 148/6.2; 106/14; 260/29.6 BM; 260/29.6 M

[51] Int. Cl.[2] ..... C23F 7/26

[58] Field of Search ..... 148/6.2, 6.16; 106/14; 260/29.6 M, 29.6 BM

[56] References Cited

UNITED STATES PATENTS

| | | | |
|---|---|---|---|
| 2,911,332 | 11/1959 | Schuster et al. | 148/6.2 |
| 3,140,204 | 7/1964 | Tokunaga | 148/6.2 |
| 3,421,949 | 1/1969 | Halverson | 148/6.2 |
| 3,472,681 | 10/1969 | Schuster et al. | 148/6.2 X |
| 3,706,604 | 12/1972 | Plaxton | 148/6.2 X |

*Primary Examiner*—Ralph S. Kendall
*Assistant Examiner*—John D. Smith
*Attorney, Agent, or Firm*—Toren, McGeady and Stanger

[57] ABSTRACT

An aqueous solution for treatment of metal surfaces which has a pH value greater than 7, and comprises no free inorganic acid and 0.1 to 10% by weight, estimated as Cr, of a chromium compound in which 5 to 40% of the initial quantity of Cr(VI) is reduced by a reaction with a trifunctional phenol.

11 Claims, 5 Drawing Figures

Figure 1:
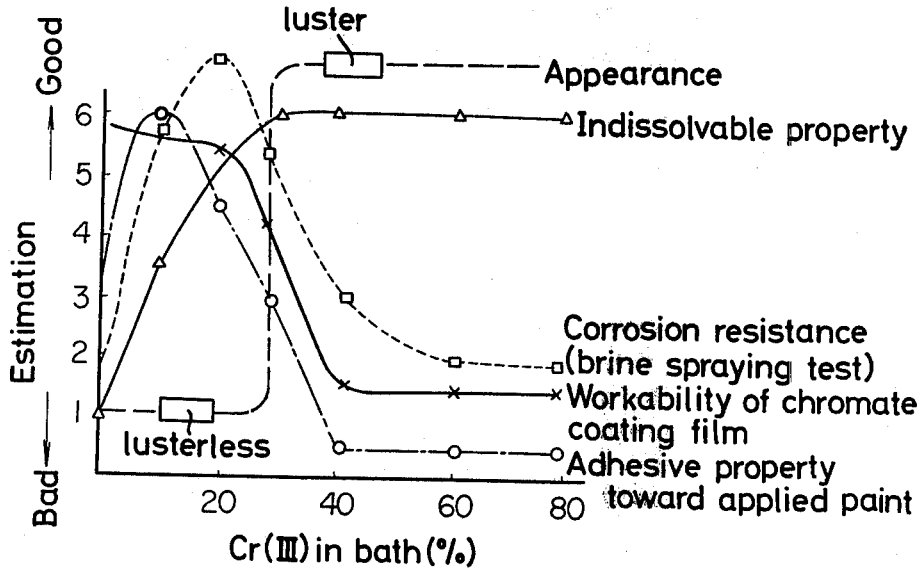

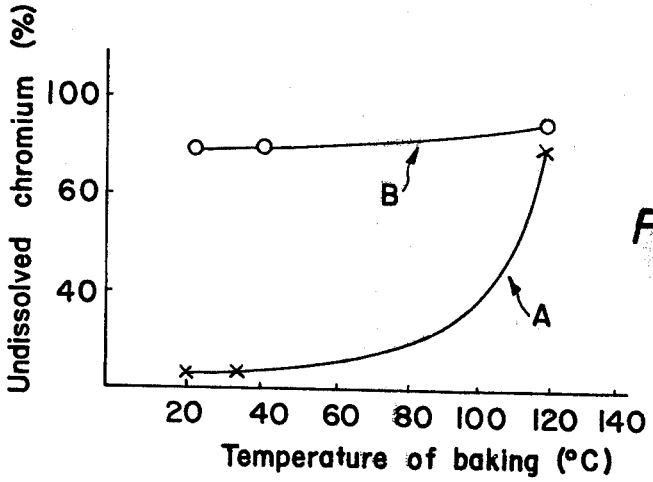
FIG. 3
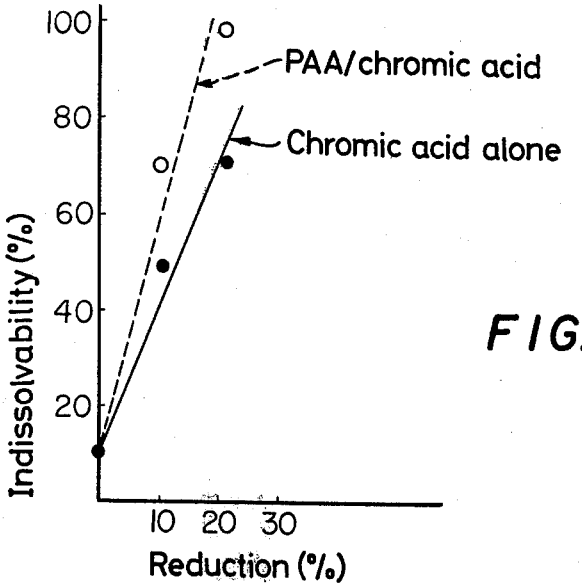
FIG. 4
FIG. 5
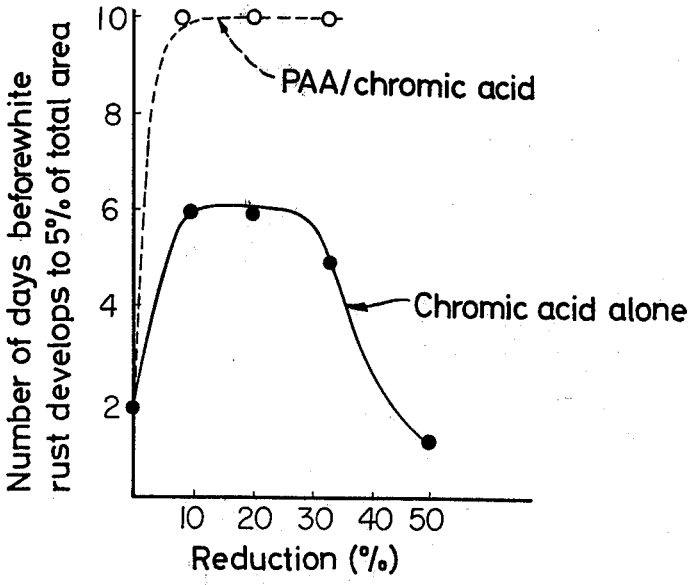

AQUEOUS SOLUTION AND METHOD FOR SURFACE TREATMENT OF METALS

The present invention relates to an aqueous solution containing chromic acid which is used for surface treatment of metals.

As is well known, various chromic acid baths have been used for treatments for preventing rust-formation on the surface of metals, especially of iron and steel, metals treated with zinc, aluminum, tin, magnesium or phosphate.

These baths have been applied extensively, for example, to a plating bath for chromium plating, various chromate treatment baths used for preventing white rust formation of tin, for electrochemical treatments, for preventing red rust-formation of iron, for producing an insulating film on an electroiron plate, an aqueous treatment solution containing chromic acid as the major constituent for blocking holes, improving corrosion resistance and preventing aging deterioration of phosphate treated metals, and a chromic acid treatment bath for the anodic oxidation and hole blocking of aluminum.

The chromate treatment solution, however, which contains toxic chromium is strictly prohibited from being drained. Therefore a chromate treatment method which does not require draining solutions and involves little dissolution of chromium after the treatment is desirable. In this respect, the chemically substitution type chromate methods, such, as "chromac" and "unichrom" method leave some problems unsolved. For instance, the high chromium contents of drained solutions from post-washing and alkaline washing, and furthermore the chromate coating film itself is not sufficiently waterproof.

In an attempt to eliminate the use of a drained solution containing chromium in continuous chromate treatment processes such as, for coil-coating, those chromates which need be only dried or baked on application without being washed with water are being employed. Chromate treatment solutions which require no water washing include solutions containing anhydrous chromic acid, solutions, consisting of anhydrous chromic acid and water glass, inorganic chromate solutions consisting of anhydrous chromic acid and phosphate and treatment solutions consisting of anhydrous chromic acid and water soluble high molecular substances.

These processes do not involve washing, and hence free from the troubles of draining chromium-containing solutions during the treatment. But the coating film becomes the less water-proof due to the larger amount of chromium added, and therefore the chromium may be dissolved while such products are being used.

The coating film of chromate or metallic chromium on the surface of the base metal has been made undissolvable, by the reaction, mostly the oxidation-reductipn reaction, of chromic acid with the base metal, by reduction of Cr(VI) and Cr(III) by means of electrolysis or by the reaction with a reducing agent or a high molecular substance that is present in the chromic acid treatment solution.

In other words, the chromate or chromium coating film on the surface of a base metal is produced by the reduction of Cr(VI) or Cr(III) existing in the treatment bath.

Properties of the chromate coating film formed on the surface of a metal are almost uniquely determined by the proportion of Cr(III) compound which provides the insolubility towards water and film hardness to the Cr(VI) compound which provides the solubility and rust preventing property.

A chromate coating film with a larger proportion of Cr(VI) has a better rust preventing property, but, on the other hand, it produces a greater amount of chromium which is a cause of environmental pollution and, when the film is further coated, blisters are more likely to be formed on the coated surface due to moisture.

On the other hand, a chromate coating film with a larger proportion of Cr(III) is harder and dissolves out less amount of chromium, and hence involves environmental problems to a lesser extent. However, it has disadvantages in that rust is more readily produced at a marred spot and the chromate coating film is easily detached on bending, by impact and by a squeeze processing.

Therefore, a chromate coating film which contains Cr(VI) and Cr(III) in appropriate proportions would be useful for practical purposes.

Processes to attain the above mentioned object include (1) partial reduction of Cr(VI) in a coating film by hydrogen that evolves on reaction of the base metal with a corrosive acid, such as, sulfuric, nitric, hydrochloric, phosphoric and organic acids that are present with the chromic acid; (2) a thermosetting reaction comprising applying on the metal surface a bath containing a reducing agent together with chromic acid and giving rise to a reducing reaction of Cr(VI) in the baking operation; and (3) partial reduction of chromate by the direct reduction in a cathodic electrolysis.

In any case, however, Cr(VI) in a treatment bath is primarily reduced in the process to obtain a chromate coating film containing both Cr(VI) and Cr(III), where the ratio of Cr(VI) to Cr(III) is necessarily indefinite.

The present invention provides a novel process for the chromic acid treatment which is independent of previous processes.

The principle of this invention is based on freely controlling the ratio of Cr(VI) to Cr(III) in the treatment bath which is applied to a metal surface and dried to produce a chromate coating film suitable to the purpose. In other words, the ratio of Cr(VI) or Cr(III) in the treatment bath is equal to that in the coating film prepared in this process of surface treatment.

Solubility of chromium compounds in water vary remarkably depending on pH of the treatment solution, valency of the chromium and nature of ions present in the solution.

Compounds of Cr(VI), that is chromic acid and dichromate, permit a stable bath to be formed in a wide range of pH and various ions to be compatible.

On the other hand, however, compounds of Cr(III) require strong acidity and the presence of anions for being stable in a bath.

For example, compounds of Cr(III), such as, sulfate, chloride, acetate and nitrate are water soluble in strongly acid solutions and compatible with dichromate, but form a precipitate of chromium hydroxide or hydrous oxide of chromium in weakly acid, neutral or alkaline solutions.

$$Cr^{+3} + SO_4^- \xrightarrow{2NH_4OH} \underset{\text{precipiate}}{Cr(OH)_3} + 2NH_4^+ + SO_4^-$$

$$Cr^{+3} + SO_4^- + Cr_2O_7^- \xrightarrow{NH_4OH} \underset{\text{precipitate}}{CrO_3.Cr_2O_3.nH_2O} + NH_4^+ + SO_4^-$$

In the process where anhydrous chromic acid in an aqueous solution is reduced, coexistence of Cr(VI) and Cr(III) is possible at pH below 3 within a limited extent, but precipitation reactions similar to those given above may take place at pH above 4.

These facts were already illustrated in Patent Publication Sho 35-3219, U.S. Pat. No. 2 768 103 and No. 2 768 104.

In this patent, a chromate coating film is produced from a chromate bath containing 0.5 to 30% of chromic acid and 0.25 to 25% of a reducing agent which is applied to the surface of iron and baked.

More particularly in this process where the reduction reaction is accelerated by the heat of baking, the ratio of Cr(VI) or Cr(III) in the bath is indefinite but generally very large, so that, as the reduction reaction proceeds at 25°C in the bath, precipitates of chromium oxide or chromium hydroxide may be probably formed in about 2 weeks, which inevitably results in deterioration of the bath.

The working period could be prolonged to approximately 3 weeks in the mentioned patent by maintaining the bath at a predetermined pH and adding a negative catalyst (a compound of manganese) to suppress the reduction reaction taking place in the bath.

This kind of difficulty should be inevitable with a bath in which a strong oxidizing agent, such as, chromic acid and a reducing agent coexist. A highly technical problem must be solved to overcome this difficulty to produce a treatment bath in which a certain definite ratio of Cr(VI) to CR(III) is maintained and is stable for a sufficiently long period.

Investigations concerning the effect of the ratio of Cr(VI) to Cr(III) on the properties of the coating film are scarce; the only one example was carried out with chromium-plating at a low pH in the presence of anions such as, sulfate. However, a bath capable of freely controlling the ratio of Cr(VI) to Cr(III) without using anions in a wide range of pH has not yet been found.

Several chromate baths are already known which contains a water soluble polymer. They are: anhydrous chromic acid-organic reducing agent-polymer (acrylic) system described in Patent Publication Sho 35-3219; anhydrous chromic acid-polyacrylamide system shown in the specification of U.S. Pat. No. 3 053 691; anhydrous chromic acid-polyacrylic acid system shown in the specification of U.S. Pat. No. 2 902 390; and anhydrous chromic acid-maleic acid copolymer system of the present inventors described in Patent Publication Sho 37-11508 and described in the specification of U.S. Pat. No. 2 921 858.

In practice, a chromate solution containing Cr(VI) and a polymer as the major constituents is applied to the surface and heated to cause the Cr(VI) to be reduced to Cr(III), and thus cross-linking of the polymer with Cr(III) and precipitates of Cr(VI) and Cr(III) which favor forming an organic chromate coating film.

Properties of the coating film are determined by the ratio of Cr(VI) to Cr(III). More particularly, when the amount of Cr(III) is too small, the resulting coating film is liable to dissolve. On the other hand, when the amount of Cr(III) is too large, the coating film will be deficient in corrosion resistance and adherence. Therefore an appropriate ratio of Cr(VI) to Cr(III) in the chromate coating film is necessary to obtain a film of high quality.

There is an additional problem which involves stability of the treatment bath and the nonsolubility property of the coating film. To enhance the insolubility property, a large amount of a reducing agent is needed or otherwise a higher temperature and a longer time of heating are required for the baking. In the former case, however, the bath will be deteriorated by progress of the reduction of Cr(VI) into Cr(III) in the bath which induces the formation of gels and further precipitates. In the latter case, large volume equipment is needed, and thus a high speed treatment is necessarily restricted. All these difficulties are inherent to the published processes cited above.

To stabilize the bath, Ludwig K. Schuster et al., added a compound of manganese to suppress the reduction rate of chromium, but still it did not suffice for use for a long time. In the chromate treatment of coil coating, a simple squeezing operation, such as, with rolls and a air-knife is applied after immersion or spraying, where also a treatment solution capable of high speed treatment is required.

The requirements are that the bath maintain a constant viscosity value, amount of precipitate and pH, and that the bath when applied on a surface of zinc does not corrode the surface and that the bath is stable even at relatively high temperatures (50° to 70°C). In addition, the chromate bath should provide an insoluble coating film by baking at a lower temperature for a relatively short time.

The properties of a chromate coating film depend on the ratio of Cr(VI) to Cr(III). According to the present inventors' investigation, a chromate coating film should retain more than 60% of Cr(VI) to prevent white rust formation on a surface of zinc, and on the other hand the chromium more readily dissolves when the content exceeds 90%.

In order to satisfy the conflicting requirements, an entirely new composition of chromate bath is required which does not rely on the previous process where an indissolvable film is formed by the oxidation-reduction reaction between the zinc surface and the chromate and also by the oxidation-reduction reaction in the baking process. The present invention provides a chromate treatment process which has solved difficult problems conflicting with each other.

More particularly, the chromate coating films provided by the present invention, that are insoluble in water and are excellent in corrosion resistance, adhesive property toward paint and workability, are prepared from a chromate treatment solution which has a ratio of Cr(VI) to Cr(III) within a predetermined range required to prevent white rust formation, said ratio being maintained because the Cr(VI) does not react with the metal surface nor the resin, and by drying the applied chromate treatment solution which hot air to accelerate the cross-linking reaction of Cr(III) in the resin and the reactions to form oxides of Cr(VI) and Cr(III). The process of this invention is, in other words, a treatment process where the ratio of Cr(VI) or Cr(III) in the treatment bath is approximately equal to that in the chromate coating film.

This process can exhibit excellent results when applied to zinc, aluminum, zinc-aluminum, and other zinc alloys, iron, steel, tin, cadmium and lead.

The bath may be applied by any method; immersing, spraying, and application with rollers. Drying is performed preferably at 60° to 150°C, but even at a temperature below 60°C, the coating film can be converted in good time into an insoluble film.

In an attemp to develop a chromate treatment bath having the above mentioned characteristics, the present inventors have found the following useful:

1. to reduce the etching of, the treatment solution is kept weakly alkaline at a pH 7 to 11 and any strongly etching anions are excluded from the bath,
2. to avoid oxidation of the resin by chromic acid, a resin stable against chromic acid oxidation should be selected and the treatment solution should be maintained at a weakly alkaline at a pH of 7 to 11, and
3. to avoid excessive reduction of Cr(VI) to Cr(III) in the bath in the drying stage or in lapse of time, a reducing agent should be selected so that the entire amount of the reducing agent is consumed in a short time and no trace remains.

Cane sugar and alcohols, commonly used for reducing agents for chromic acid, are not suitable for the present purpose because these reducing agents leave a fraction unreacted and the resulting solution forms a precipitate when made alkaline.

The present inventors have selected as reducing agents for the present object, polyvalent phenols which react completely and instantaneously with chromate ion in an alkaline medium, and have succeeded in developing a chromate bath that satisfies the above mentioned requirements by employing an aqueous alkaline solution of chromate containing both polyvalent phenol and water soluble polymer. Here, Cr(III) produced by reduction forms water-soluble stable chelates with carboxyl groups and polyvalent phenols to form high molecular weight substances. When the aqueous solution is applied and dried, Cr(III) reacts to form cross-linkages with carboxyl and hydroxyl groups and forms a rigid high-molecular coating film. The coating film can hold Cr(VI) to minimize the dissolution. It is also possible to add to the film a coloring agent such as pigment and dyestuffs and to keep it from being dissolved.

The present invention provides a stable chromate bath in aqueous solution by adding a trivalent phenol to an aqueous solution of Cr(VI) of pH greater than 7 to complete the reaction of Cr(VI) with the phenol, where a definite ratio of Cr(VI) to Cr(III) is attained by adding a calculated amount of trivalent phenol.

The present invention will be described in more detail referring to the attached drawings.

FIG. 1 shows the relation between the Cr(III) content (%) of the bath and properties of resulting chromate coating films.

Figure 2:
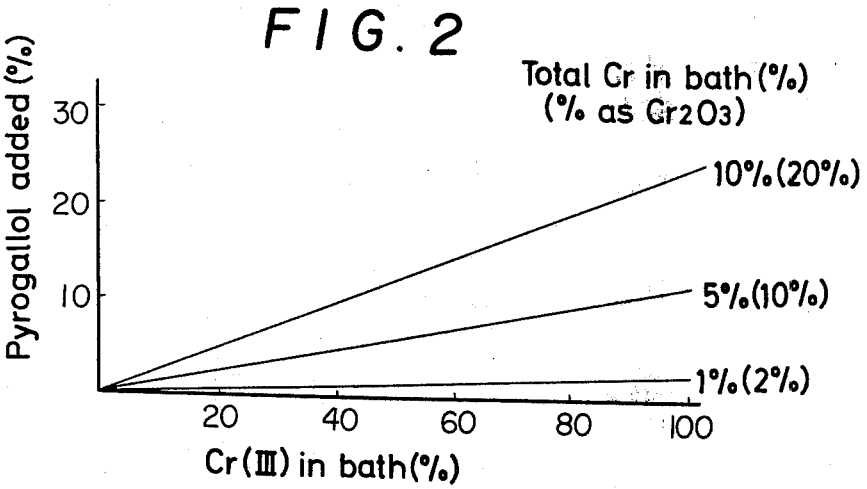

FIG. 2 shows the relation between the amount of pyrogallol added as reducing agent and the percentage of reduction, FIG. 3 shows the relation between the baking temperature and the percentage of undissolved chromium in boiling water when pyrogallol and triethanolamine are used as the reducing agent, FIG. 4 shows the effect of the addition of resin on the property (1 min. in boiling water), and FIG. 5 shows the effect of adding a resin on corrosion resistance (brine spraying test) with respect to the same test specimen as used in FIG. 4.

As is shown in FIG. 2, one mole of trivalent phenol suffices to complete the reduction of one mole of Cr(VI) to Cr(III).

The relation between the amount of reducing agent and the percentage of reduction, as is shown in FIG. 2 for pyrogallol as reducing agent, is linear independently of the pH values. Thus, adding 0.1 mole of a reducing agent per one mole of Cr(VI) is adequate to obtain a 10% reduction bath.

Among the chromate coating films produced by the process of this invention of which properties vary as seen in FIG. 1 depending on the ratio of Cr(VI) to Cr(III), the best ones are obtained from a bath containing 10 to 30% of Cr(III).

More particularly, FIG. 1 shows dependence of the chromate coating films on the per cent of Cr(III) content in percentage in the bath. Actually, pyrogallol was added to a 3% aqueous solution of ammonium chromate of pH 9.4 so that 0 to 80% of the chromium was reduced to Cr(III). The aqueous solution thus prepared was applied to a steel plate which had been covered with molten zinc, and dried at 60°C of the temperature measured on the surface. Then the properties were estimated.

The indissolvable property was determined from analysis of the amounts of chromium both dissolved and remaining in the films, while the corrosion resistance was determined by the brine spraying test according to JIS.Z.2371.

Workability was estimated by the Du Pont impact test (½ in., 50 cm, 1Kg in JIS.K5400 B and by the Erichsen test (10 mm) in JIS.B 7777. The adhesive property of a coating paint was estimated from the results of the Du Pont impact test and the Erichsen test of specimens which had been coated with a white melamine alkyd resin paint to a thickness of 25 $\mu$ by spraying followed by baking at 120°C for 30 min. Visual observation was applied for decision.

The fact that properties of a chromate coating film of the Cr(III) content above 30% are surprisingly different form those of the content below 30% is of academic interest. The present invention which revealed this fact should be recognized as being based on rigorously scientific experimentation.

Inventions which have any connection with the present one include, other than those which have been referred to above, U.S. Pat. No. 2 777 785 and others.

In these patents, the reducing agents used are exclusively phenol, hydroquinone, cane sugar, glucose, glycol, polyethyleneglycol, glycerine, mannitol, sorbitol, triethanol amine and hydroxylamine. Among them polyvalent alcohols are the most effective reducing agents. However, they exhibit strong reducing action toward chromic acid in an acidic medium, where deterioration of the bath due to formation of precipitates of hydroxide and oxide of chromium is a serous problem.

Reducing agents used in the bath of the present invention are polyvalent, preferably trivalent, phenols, which have a peculiar action. Thus, they exhibit strong reducing action in an alkaline medium and Cr(III) formed does not precipitate but remains stable in the aqueous solution. This behavior is peculiar to trivalent phenol, not observable in mono- and di-functional phenol which Schuster et al. used.

Following descriptions are concerned to detailed explanation of the composition of the bath.

The chromium compounds used in the present invention include water soluble salts of chromate and dichromate, that is, salts of ammonium, alkali metals (lithium, potassium, sodium), alkaline earth metals (berylium, magnesium, calcium, zinc, strontium, barium and cadmium), and anhydrous chromic acid.

Appropriate concentrations ranges between 0.1 to 10% as Cr depending on object and method of treatment.

Ordinary zinc-plated iron plates can be sufficiently prevented from forming white rust with a coating film containing 10 mg Cr/m², where the concentration 0.5 to 1.0% is appropriate.

When a highly corrosion-resistant coating film such as that of Unichrom is desired, 50 to 100 mg Cr/m² is needed, where the bath concentration should be 5 to 10%.

Trivalent phenols used include derivatives of pyrogallol, phloroglucin and gallic acid expressed by the following general formulae where $R_1$, $R_2$ and $R_3$ are a hydrogen atom, a hydrocarbon group or a carboxyl group.

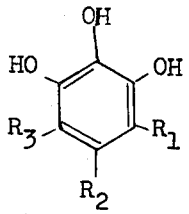

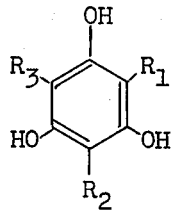

The amount to be added differs depending on the concentration of Cr(VI) and the desired extent of reduction. This amount should be decided according to the graph showing the relation between amounts of trivalent phenol to be added and the precentage of reduction, as is exemplified in FIG. 2 with respect to pyrogallol. To obtain a chromate coating film of excellent quality and satisfactorily insolubility in water, the reduction percentage should be in the range 5 to 40%, preferably 10 to 20%.

The pH of the bath, one of the most important factors of this invention, should be at least greater than 7.

Namely, since Cr(III) exhibits strong reducing activity only in an alkaline medium, the desired reduction reaction is instantaneously completed at the mentioned pH range and thus a stable aqueous solution results. Further, the alkaline medium is favored to prevent the metal surface from being etched.

The pH can be adjusted to the desired value most favorably with aqueous ammonia which is volatile, but amines and sodium hydroxide may also be available.

The treatment bath is prepared using the following procedure: at first a compound of chromium is dissolved in water, the pH thereof is adjusted to above 7, and an aqueous solution of trivalent phenol is added to the above solution.

The presence of a water soluble polymer in the treatment bath makes the water-insoluble chromate coating films more corrosion resistant.

FIG. 4 shows that, when an acrylic acid resin is added to an aqueous solution of ammonium chromate which has been partly reduced with pyrogallol, the indissolvable property is more improved for the same percentage of reduction. The data for FIG. 4 was obtained with a test specimen which had been prepared by applying the chromate solution to 100 Cr mg/m² to a molten zinc-plated steel plate and the resulting plate was dried at 60°C.

FIG. 5, which demonstrates the result of the brine spraying test of the same test specimen as in FIG. 4, shows the apparent improved corrosion resistance at lower percentage of reduction when a resin was added.

The effective water soluble polymers to be used in the bath of the present invention include polyacrylic acid and copolymers of acrylic acid with acrylic acid ester containing carboxyl groups, maleic acid copolymers, maleic acid ester copolymers, polyacrylamides, acrylonitrile polymers, polyvinyl alcohols, polyvinyl pyrrolidone and polyvinylmethyl ethers. The recommended amount of addition is 0.01 to 10%, preferably 0.5 to 3%.

Coloring agents to be used for giving a color to the chromate coating film are pigments of which the particle size is less than 1μ. They include, for example, phthalocyanine green, phthalocyanine blue, titanium white, carbon black, red ion oxide, $Cr_2O_3$, zinc chromate, ferrocyan blue, zinc dust, and alumina dust. The coloring material is added by 0.03 to 1 part, preferably 0.3 to 1 part, per part resin.

The bath may be applied by any means available; that is immersion and spraying followed by squeezing with rollers or air-knife, or by roller coating, by flowing and by brushing.

Drying to such an extent as to expel water is sufficient. Even air-drying suffices to provide a water-proof chromate coating film. However, drying at 60° to 100°C on the surface is preferred.

The baths specified in the specifications of previously published patents requires baking to be performed at a higher temperature 250°F (120°C) on the surface, as evidenced also by the present inventors.

In FIG. 3, which shows the relation between the temperature of baking and the indissolvable property, A corresponds to 3% of ammonium chromate and 2% of triethanolamine and B to 3% of ammonium chromate and 0.6% of pyrogallol.

Examples of the present invention are shown below.

EXAMPLE 1

To a 3% aqueous solution of ammonium chromate, 0.6% (treatment bath A) and 0.9% (treatment bath B) of pyrogallol were added separately. The resulting aqueous solutions of pH 10 were applied to molten zinc-plated steel plates with grooved and smooth rollers, and the surface was dried with hot air at 60°C.

The amounts of chromium in the films, indissolvable property and other properties are listed in Table 1.

Table 1

| | | Properties of coating films | | | |
|---|---|---|---|---|---|
| Bath | Roller | Total Cr (mg/m²) | % of Cr dissolved[1] | S.S[2] | Adhesive property of paint[3] |
| A | smooth | 20 | 0 | 24 | good |
| A | grooved | 100 | 20 | 240 | good |
| B | smooth | 20 | 0 | 24 | good |
| B | grooved | 100 | 5 | 240 | good |

[1]Immersion in boiling water for 1 min.
[2]Time before generation of white rust in the brine spraying test according to JIS.Z.2371
[3]Cross-cut test of a white melamine alkyd enamel surface of 25μ thickness which had been baked at 120°C for 30 min.

The percentage of reduction was 20% with the chromate bath A and 30% with B.

EXAMPLE 2

To a 1% aqueous solution of ammonium chromate of pH 9.5, 0.2% of phloroglucin was added, and the resulting solution of 20% reduction was applied on a molten zinc-plated steel plate with grooved rollers so as to be 50 Cr mg/m², and the surface was dried with hot air at 60°C.

When the plate was immersed in boiling water for 1 min., only 10% of the total Cr was dissolved. No generation of white rust was observed in the brine spraying test for 168 hours.

EXAMPLE 3

The chromate bath B in Example 1 was applied on clean surfaces of a cold-rolled steel plate and an aluminum-plated steel plate to the amount so as to result in 100 Cr mg/m² using grooved rollers. Then the surface were dried at 60°C.

About 10% of chromium wad dissolved in treatment with boiling water, and in the brine spraying test rust was generated in 24 hours with the steel plate and in a month with the aluminum-plated steel plate.

EXAMPLE 4

An aqueous solution of 20% reduction was prepared by adding 3% of pyrogallol to a 1.5% aqueous solution of sodium chromate. The resulting solution was applied to the surface of a molten zinc-plated steel plate using a smooth rollers, which was then dried with hot air. The total quantity of chromium attached amounted to 20 Cr mg/m². Generation of white rust was observed in the brine spraying test in 48 hours and not a trace of rust could be found in 120 hours in a moist tank test.

EXAMPLE 5

A 3% aqueous solution of magnesium chromate was adjusted to pH 9.5 with ammonia, to which 0.3% of pyrogallol was added to prepare an aqueous solution of approximately 10% reduction. This was applied to a molten zinc-plated steel plate with grooved rollers and dried with hot air to 80°C at the surface. The total amount of chromium on the surface was 100 Cr mg/m².

The molten zinc-plated steel plate dissolved only about 20% of Cr in 1 min. immersion in boiling water and no rust formation was observed in a 240 hour brine spraying test.

EXAMPLE 6

To an aqueous solution of pH 9.3 containing 3% of ammonium chromate and 2% of polyacrylic acid, 0.3% of pyrogallol was added to prepare an aqueous solution of 10% reduction. A molten zinc-plated steel plate was immersed in the solution, squeezed with grooved rollers to obtain a uniform surface, and then dried with hot air for 10 sec. The temperature on the surface was 60°C and the total amount of chromium was 100 Cr mg/m².

The resulting plate was immersed for 1 min. in boiling water. The amount of dissolved chromium was estimated to be 30 mg/m² (30%). It took 240 hours in the brine spraying test of the same specimen before white rust was observed on the surface.

EXAMPLE 7

A treatment bath the same as in Example 6 was prepared wherein the polymer was replaced by 1% of a copolymer (acid value being 300) of polyacrylic acid with butyl acrylate.

A molten zinc-plated iron wire (5 mmϕ) was immersed in the bath, and then dried with hot air for 30 sec. at 150°C, when the surface temperature of the wire was 60°C.

The wire thus obtained produced no trace of white rust for 10 days and more than a month in a moist tank test (49°C, 98%), Remaining chromium after a month of the moist tank test amounted to 60%.

EXAMPLE 8

To an aqueous solution of pH 9.4 containing 2% of styrenemaleic acid copolymer (degree of polymerization being 140) and 3% of ammonium chromate, 0.3% of pyrogallol was added, so that the ratio of Cr(III) to Cr(VI) was approximately 1.2 : 8.8. Viscosity of the bath was 9 centipoise.

The treatment solution was applied with grooved rollers on the surface of a molten zinc-plated steel plate to obtain the total amount of chromium of 100 Cr mg/m², which was then dried with hot air with the surface temperature being 60°C, and followed by baking.

Immersion in boiling water dissolved 10 mg/m² of chromium. No white rust formation could be observed for 12 days in the brine spraying test (JIS-Z-2371) and for 16 days in the moist tank test (JIS-Z-0228).

The treatment bath, in turn, was stable enough and underwent little change in characteristics such that the pH was 9.3, the ratio of Cr(III) to Cr(VI) was 1.2 : 8.8 and the viscosity was 8 centipoise after storage for 3 months at 50°C.

EXAMPLE 9

To an aqueous solution of pH 8.5 containing 2% of styrenemaleic acid copolymer (degree of polymerization being 140) and 3% of ammonium chromate, 0.5% of pyrogallol was added to prepare a chromate solution in which the ratio of Cr(III) to Cr(VI) was 2 : 8. The viscosity of the bath was 10 centipoise. The treatment solution was applied to the surface of a molten zinc-plates steel plate with grooved rollers so that the total amount of chromium amounted to 100 Cr mg/m², and then the surface was dried with hot air at a temperature of 70°C on the surface.

Immersion in boiling water dissolved 10 mg/m² (10%) of chromium for 5 min. and 8 mg/m² (8%) for 1 min. in a 2% aqueous solution of sodium carbonate at 50°C.

No white rust formation was observed in a 12 day brine spraying test and also in a 16 day moist tank test.

The treatment bath kept the quality almost the same to that at the initial stage for 3 month's storage at room temperature.

EXAMPLE 10

To an aqueous solution of pH 8 containing 2% of vinyl methyl ether-maleic acid copolymer and 3% of ammonium chromate, 0.3% of pyrogallol was added to obtain an aqueous solution in which the ratio of Cr(III) to Cr(VI) was 1.2 : 8.8. Viscosity of the bath was 10 centipoise. This treatment solution was applied to the surface of a molten zinc-plated steel plate with grooved rollers so that the total amount of chromium amounted to 100 Cr mg/m² and the surface was dried with hot air at 70°C on the surface.

Immersion in boiling water dissolved 10 mg/m² of chromium for 5 min.

White rust was not observed to form for 12 days in the brine spraying test and 16 days in the moist tank test. The treatment bath maintained its original condition for 3 month's storage at 50°C, that is a viscosity of 10 centipoise and pH being 8.1.

EXAMPLE 11

To an aqueous solution of pH 9 containing 4% of styrene-ethyleneglycol ester of maleic acid copolymer and 3% of ammonium chromate, 0.6% of pyrogallol was added to prepare an aqueous solution for chromate treatment bath in which the ratio of Cr(III) to Cr(VI) was 2.5 : 7.5. Viscosity of the bath was 5.5 centipoise. This solution was applied on the surface of a molten zinc-plated steel plate and was squeezed with an air-knife so that the total chromium amounted to 100 Cr mg/m², and then dried with hot air at 70°C on the surface.

Immersion in boiling water dissolved 7 mg/m² (7%) of chromium in 5 min.

No generation of white rust could be observed in 12 day brine spraying test and also in a 16 day moist tank test.

The treatment bath remained almost unchanged for 3 months when kept at 50°C. Thus the viscosity was 4.5 centipoise and pH was 9.0.

EXAMPLE 12

A chromate bath having the same reduction as in Example 8 was prepared by replacing the pyrogallol by 0.4% of gallic acid in preparation of bath in Example 9.

The treatment bath remained almost unchanged for 2 months at 50°C.

Both the indissolvable property and corrosion resistance were excellent. Thus, the dissolution of chromium was only 10% of the total amount of chromium when immersed in boiling water for 5 min. and 8% when immersed in a 2% aqueous solution of sodium carbonate for 1 min. at 50°C.

EXAMPLE 13

The same treatment solution as in Example 8 was applied by spraying to the surface of an electrolytically zinc-plated steel plate having 5μ thickness of plated layer, so that the total chromium amounted to 100 mg/m², squeezed with an air-knife to obtain uniform application, and then dried and baked with hot air with the surface temperature of 70°C. Immersion in boiling water dissolved only 7% of total chromium for 5 min.

EXAMPLE 14

The treatment solution in Example 9 was applied to a molten aluminum-plated steel plate with grooved rollers so that the total chromium amounted to 100 mg/m², and then baked with the surface temperature of 70°C. The chromate coating film dissolved only 5% of the total amount when immersed in boiling water for 5 mn. No generation of white rust was observed in 1 month of the brine spraying test and in 2 months of the moist tank test.

What is claimed is:

1. An aqueous solution for treatment of metal surfaces which has a pH value greater than 7, and consists essentially of 0.01 to 10% by weight, estimated as Cr, of a chromium compound in which 5 to 40% of the initial quantity of Cr(VI) is reduced by reaction with a trifunctional phenol and which possesses no free inorganic acid.

2. The aqueous solution according to claim 1, wherein 0.01 to 10% by weight of a water soluble high molecular compound selected from the group consisting of polyacrylic acid and copolymers of acrylic acid with acrylic acid esters containing carboxyl groups, maleic acid copolymers, maleic acid ester copolymers, polyacrylamides, acrylonitrile polymers, polyvinyl alcohols, polyvinyl pyrrolidone and polyvinylmethyl ethers is present

3. An aqueous solution according to claim 1, wherein the trifunctional phenol is one or more members selected from the derivatives of pyrogallol, phloroglucine or gallic acid.

4. An aqueous solution according to claim 1, wherein 10 to 30% of Cr(VI) is reduced by the reaction with the trifunctional phenol.

5. An aqueous solution according to claim 1, wherein the chromium compound is one or more members selected from the group consisting of water soluble salts of chromate and dichromate such as salts of ammonium, alkali metals (lithium, potassium, and sodium), and alkaline earth metals (berylium, magnesium, calcium, zinc, strontium, barium and cadmium) and anhydrous chromic acid.

6. An aqueous solution according to claim 2, wherein the water soluble high molecular substance is present in an amount from 0.5 to 3% by weight.

7. An aqueous solution according to claim 1, wherein 0.005 to 0.2% by weight of silicone is is present as a bubble extinguishing agent.

8. An aqueous solution according to claim 7, wherein a coloring agent is present.

9. An aqueous solution according to claim 1, wherein one or more members selected from the group consisting of ammonia, amines, sodium hydroxide and potassium hydroxide is added for adjusting the pH of the solution.

10. A process for treating a metal surface at a temperature between 20° to 70°C using the aqueous solution of claim 1.

11. A process according to claim 10, wherein the temperature on the surface of the plate is 60° to 100°C.

* * * * *